US009375780B2

(12) United States Patent
Fortmeier

(10) Patent No.: US 9,375,780 B2
(45) Date of Patent: Jun. 28, 2016

(54) FORMING TOOL WITH PUNCH

(71) Applicant: Benteler Automobiltechnik GmbH, Paderborn (DE)

(72) Inventor: Günter Fortmeier, Delbrück (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 14/613,020

(22) Filed: Feb. 3, 2015

(65) Prior Publication Data

US 2015/0217363 A1 Aug. 6, 2015

(30) Foreign Application Priority Data

Feb. 4, 2014 (DE) ..... 10 2014 101 349

(51) Int. Cl.

| | |
|---|---|
| ***B21J 13/08*** | (2006.01) |
| ***B21D 28/32*** | (2006.01) |
| ***B21D 28/36*** | (2006.01) |
| ***B21D 35/00*** | (2006.01) |
| ***B21J 5/02*** | (2006.01) |
| ***B21J 9/02*** | (2006.01) |
| ***B21J 13/02*** | (2006.01) |
| ***B21K 7/12*** | (2006.01) |

(52) U.S. Cl.

CPC ..... *B21J 13/085* (2013.01); *B21D 28/325* (2013.01); *B21D 28/36* (2013.01); *B21D 35/001* (2013.01); *B21J 5/025* (2013.01); *B21J 9/02* (2013.01); *B21J 13/02* (2013.01); *B21K 7/12* (2013.01)

(58) Field of Classification Search

CPC .... B21D 28/325; B21D 28/36; B21D 35/001; B21J 13/085; B21J 5/025; B21J 9/02; B21J 13/02; B21K 7/12

See application file for complete search history.

(56) References Cited

U.S. PATENT DOCUMENTS

| | | | | | |
|---|---|---|---|---|---|
| RE22,106 | E * | 6/1942 | McCreary | B21D 24/005 | 72/349 |
| 2,491,317 | A * | 12/1949 | Klocke | B30B 1/06 | 100/295 |
| 2,541,534 | A * | 2/1951 | Muir | B21C 1/26 | 72/347 |
| 4,867,022 | A * | 9/1989 | Hird | G01B 3/1061 | 83/176 |
| 4,916,951 | A * | 4/1990 | Messner | B21D 37/145 | 72/448 |
| 5,471,901 | A | 12/1995 | Nishiya et al. | | |
| 6,240,759 | B1 * | 6/2001 | Blaimschein | B21J 7/14 | 72/452.6 |
| 8,671,729 | B2 * | 3/2014 | Verma | B21D 37/16 | 72/342.2 |

(Continued)

FOREIGN PATENT DOCUMENTS

| | | |
|---|---|---|
| DE | 43 34 417 A1 | 4/1994 |
| DE | 103 40 509 | 3/2005 |

(Continued)

*Primary Examiner* — David B Jones

(74) *Attorney, Agent, or Firm* — Henry M. Feiereisen LLC

(57) ABSTRACT

A forming tool for press forming a plate includes a top die and a bottom die, wherein in a dosed state of the forming tool a mold cavity remains between the top die and the bottom die and a punch is provided which can be moved relative to the forming tool in a movement direction, which punch is at least movable into the mold cavity and the punch is supported elastically with at least one further degree of freedom of movement, wherein the degree of freedom of movement is oriented transverse to the movement direction, wherein the punch has a foot region and is pivotally supported at the foot region.

17 Claims, 5 Drawing Sheets

(56) References Cited

U.S. PATENT DOCUMENTS

Figure 1:
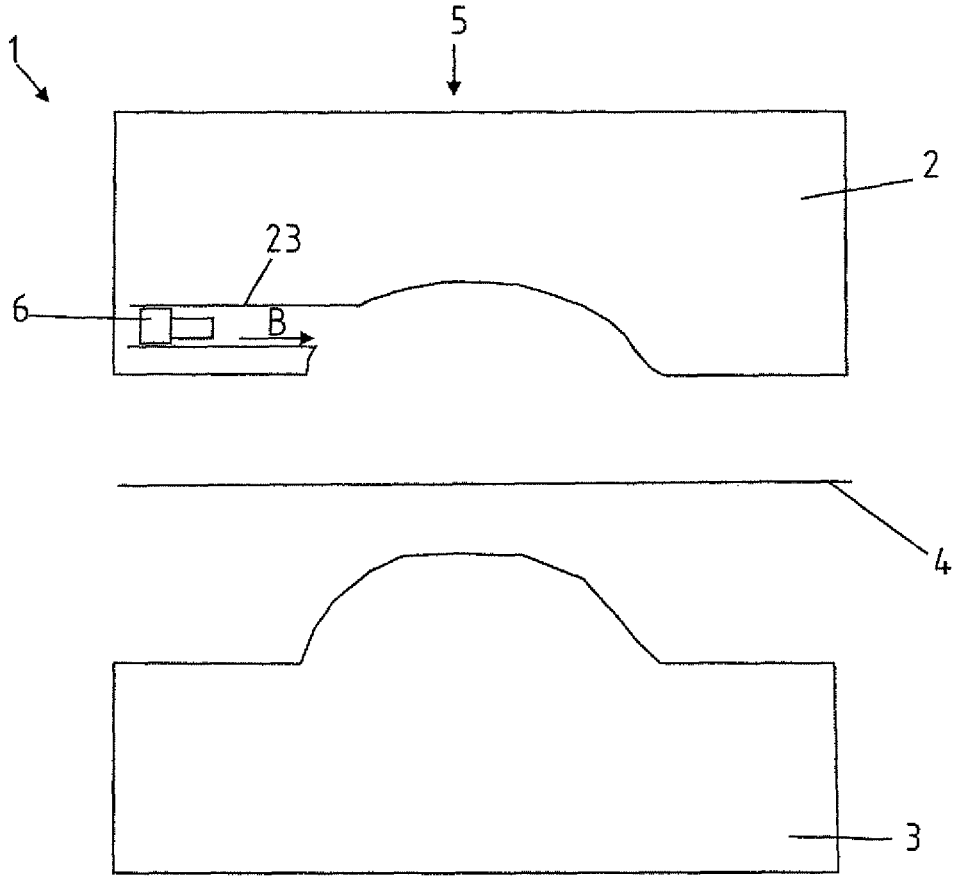

| | | | |
|---|---|---|---|
| 2006/0150706 | A1 | 7/2006 | Heinl |
| 2010/0018277 | A1 | 1/2010 | Hielscher |

FOREIGN PATENT DOCUMENTS

| | | | |
|---|---|---|---|
| DE | 10 2008 034 996 | B4 | 2/2010 |
| DE | 10 2011 116 714 | A1 | 4/2013 |

* cited by examiner

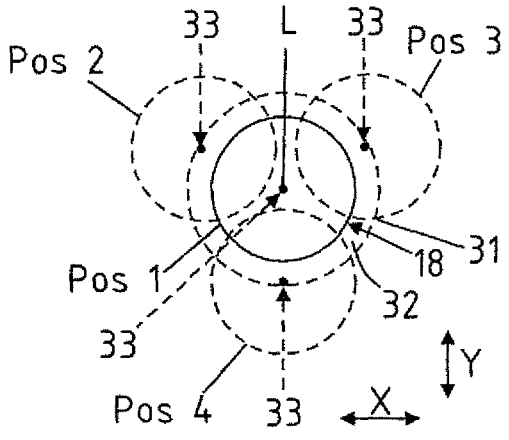
FIG. 6
FIG. 7a)
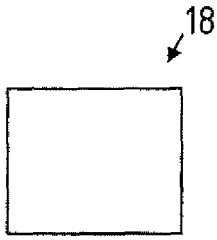
FIG. 7b)
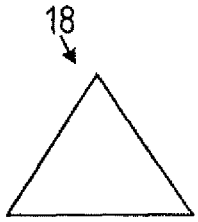
FIG. 7c)
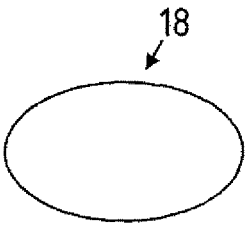
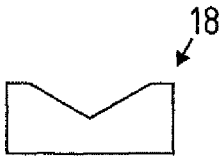
FIG. 7d)

FORMING TOOL WITH PUNCH

CROSS-REFERENCE TO RELATED APPLICATIONS

This application claims the priority of German Patent Application, Serial No. 10 2014 101 349.2, filed Feb. 4, 2014, pursuant to 35 U.S.C. 119(a)-(d).

BACKGROUND OF THE INVENTION

The present invention relates to a forming tool with punch according to the features in the preamble of patent claim 1.

From the state of the art it is known to produce sheet metal products by press-forming. These sheet metal components are in particular used in motor vehicle construction as structural vehicle body parts or as outer panels of a vehicle body. For these metallic materials, in particular steel materials in the form of sheet metal blanks are provided, wherein the blanks are then inserted into a press-forming tool and are formed by press-forming. For this a press-forming tool has a top die and a bottom die, wherein the top die and the bottom perform a vertical movement after which a mold cavity remains between the top die and the bottom die, which imposes a corresponding three-dimensional contour on the plate.

From the state of the art in particular the hot-forming and press-hardening technology is known in which the blank prior to heat treatment is heated above austenizing temperature, i.e., above 850° C., so that an austenization has occurred. The plate is then formed while in the hot state, because in this state it can be formed with a high degree of freedom while requiring only small forming forces. Subsequent thereto the plate is cooled fast or quenched so that the austenitic microstructure is transformed into a martensitic microstructure and thereby a significantly higher strength or hardness properties are established. A risk of delayed fracture or the occurrence of micro cracks such as in hard-cutting is thus avoided.

However, sometimes not only forming operations but also punching or cutting operations have to be performed prior to hardening because the forces required for the punching or cutting are smaller in this case and the wear of the punching or cutting tools is lower than in a hardened component.

Recesses or holes have to be introduced in particular so that screw connections can be generated or cables can be guided through. In order to generate such recesses on a component, corresponding punches are known from the state of the art. For example a combined forming and punching tool is known from DE 10 2008 034 996 B4. Hereby a corresponding hole punching operation is performed with the forming itself.

When three-dimensional, complex formed components are used or components with different wall thicknesses, inaccurate contact occurs in the mold cavity especially in the region of the punch between the top die and the bottom die and the already mostly formed plate situated there between.

SUMMARY OF THE INVENTION

In light of the state of the art it is an object of the present invention to set forth a forming tool with which it is possible independent of the wall thicknesses of the component to be produced and/or independent of the state of wear of the forming tool, to produce hole punching operations with high precision.

The aforementioned object is solved according to the invention with a forming tool including a top die and a bottom die, wherein in a closed state of the forming tool a mold cavity remains between the top die and the bottom die; a punch having a foot region and being pivotally supported by a pivotal support at the foot region, said punch having a first degree of freedom of movement so as to being movable relative to the forming tool in a movement direction, said punch being at least movable into the mold cavity and being supported elastically with at least one further degree of freedom of movement oriented transverse to the movement direction.

Advantageous embodiments are the subject matter of the dependent claims.

The forming tool for press-forming a plate has a top die and a bottom die, wherein when the forming tool is closed a mold cavity remains between the top die and the bottom die and a punch is provided which is movable relative to the forming tool in a direction of movement, and which can at least be moved into the mold cavity and is elastically supported with at least one degree of freedom of movement, wherein the degree of freedom of movement is oriented transverse to the direction of movement of the punch. According to the invention the punch is pivotally supported at a foot region.

Within the framework of the invention this means that the punch is non-displaceably supported in the direction of movement, i.e., the movement performed for punching, so that the punching force required for the punching is transmitted substantially rigidly in the direction of thrust. However, transverse to the direction of movement in particular an end or punch head is supported with at least one degree of freedom of movement, which extends transverse to the direction of movement. This is realized according to the invention in that a foot region of the punch is pivotally supported with a roller body or cylinder or as an alternative with a ball head. This pivotal support thus transmits the required punch force substantially thrust-rigid in the direction of movement and at the same time permits the shaft of the punch, and in particular the punch head, to move transverse to the direction of movement with at least one degree of freedom of movement.

A particular preferred embodiment is the support by means of a ball head, which can also be referred to as gimbal support. This enables the punch head to move in two translational directions respectively transverse to the direction of movement and to assume any position in a predetermined space, in particular in the following referred to as enveloping space. The punch head thus moves in an enveloping circle.

However, the punch would move about its own axis, which is undesired in particular in head termini that are not circular. For this according to the invention an anti-rotation mechanism, in particular in the form of an anti-rotation pin, is guided through the ball head, in particular so as to intersect with the center of the sphere of the ball head, so that two pin projections each project at opposing ends from the ball head. The ball head itself is supported in a ball socket, wherein grooves are provided in the ball socket into which the pin projections of the anti-rotation pin engage. These grooves together with the pin projections form a respective floating bearing with a translational degree of freedom, so that the punch cannot rotate about its longitudinal axis, but the punch head is pivotal within the predetermined enveloping circle. For example when a quadrangular or triangular hole has to be punched, a correct setting of the hole pattern is ensured by the fact that the punch head does not rotate about the longitudinal axis of the punch, which enables accommodating production tolerances with the punch.

In particular, the punch is elastically supported so that it is in a centered position or zero position in the starting state or resting state, i.e., the state prior to contact with the sheet metal to be punched. Upon contact with the sheet metal the head end can then depart from this centered position due to the pivotal support and can perform the punching. After the punching and retrieval of the punch from the created hole, the punch is returned to its centered position due to the elastic support. The forming tool according to the invention is in particular configured as hot-forming and press-hardening tool. When the forming tool is operated in a serial production, the forming tool itself is subjected to abrasive wear and/or inaccuracies occur in the region of contact between the top die and the plate and the plate and the bottom die, in particular the region of the punch, due to components with different wall thicknesses.

According to the invention the punch moves at least partially, in particular completely, into the mold cavity and particularly preferably moves through the mold cavity and thereby performs the punching. The punched out material can then be received in a region opposite the punch or the punched section can be discharged via a corresponding discharge channel. In the case the inaccuracy is such that it would lead to jamming when starting up a punch known from the state of the art, it is provided according to the invention that a further degree of freedom of movement of the punch is provided, which is arranged transverse to the direction of movement of the actual hole punching process. The punch is thus provided with a tolerance compensation capability, so that the punch can still perform the punching and at the same time does not become jammed. The elastic support is thus essentially formed in radial direction of the punch. Hereby the punch may be supported elastically in only one direction, alternatively in two opposing radial directions or it can be elastically supported radially circumferentially.

In particular this tolerance compensation is formed by a radially elastic support in connection with a slant on the head of the punch and a corresponding counter slant or inner slant on the hole of the tool opposite the punch, into which the punch moves. A corresponding tolerance compensation thus occurs during the movement in movement direction for the hole punching such that that the punch moves through the plate and due to the slant a centering relative to the opposing hole template occurs. The return movement of the punch to its starting position is caused by the radially circumferential elastic support. Within the scope of the invention it is also possible that only the punch has a slant or as an alternative the hole into which the punch moves on the opposite side has a corresponding inner slant. As an alternative the punch can also be tapered toward its free end. In particular the free end is in this case configured to have an outer radius, which is smaller than an inner radius of a corresponding opening into which the punch moves. Also in this case a self-centering would be performed in connection with the radial support.

As a result punching operations can thus be performed in a component within a forming tool, independent of the wear condition of the forming tool and/or possible inaccuracies of the contact of the plate inside the mold cavity, in particular due to different wall thicknesses and/or complex forming degrees.

A further significant advantage is that the punch not only performs a movement in the tool closing direction, i.e., a substantially vertical direction, but can perform a hole punching movement at any angle relative the vertical direction and in particular a hole punching movement in horizontal direction. For this, the punch is in particular supported on carriages, wherein the carriage is preferably drivable relative to the forming tool by a third drive source. In particular the punch is supported in the top die or in the bottom die so that the drive source then moves the punch relative to the top die or the bottom die. The drive source itself is configured mechanical, electrical, hydraulic or pneumatic. Within the framework of the invention, in particular a servo drive or a hydraulic drive is used. It is also possible to provide a corresponding deflection kinematics so that the punch is connected with the press tool drive itself. The carriage is now moved for performing the punching movement in the direction of the mold cavity, wherein the punch itself is fixed as longitudinal projection on the carriage.

The punch is fixed on the carriage so that the punch is coupled thrust-rigid in movement direction at a foot region with the carriage. In particular the thrust-rigid coupling is accomplished via a cylinder or a ball head, respectively according to the principle of a sliding bearing. The cylinder makes it possible for the punch to perform a pivot movement at least by a few degrees about the cylinder axis. When using a ball head, the punch can perform a rotating pivot movement about the ball head. The punch is configured as longitudinal projection and is radially elastically supported in the direction toward its head-side end. In particular this support is accomplished by elastic support rings, which are pushed onto the punch and/or radially engage around the punch. Preferably the support rings themselves are exchangeable thus enabling a corresponding maintenance of the punch. In particular the support rings are arranged in a hollow space of the carriage or are positionally secured against axial movement with a closure ring, for example a retaining ring or a closure cap.

Within the framework of the invention, the support rings are made of a temperature resistant material so as to also withstand temperatures above 200° C. or more at least for a short period of time. As an alternative it is possible that spring elements, which engage in radial direction on the punch, are arranged which then take over the elastic support of the punch. In particular the spring elements are made of a metallic material so that they are resistant against temperatures above 200° C., in particular above 500° C.

The punch further has a slant at its head. Complementary to the slant, the opposing region of the forming tool has a slant, in particular in a region on the bottom die, for the case that the punch is supported on the top die for relative movement. The punch thus moves into the inner slant and the opening situated behind the inner slant to perform the punching movement. For this, particularly preferably an exchangeable hole plate, in the following also referred to as hole template, is provided. In an embodiment the hole and the inner slant can be introduced directly into the tool or the mold surface. When performing a serial production, however, wear may occur so that while the forming tool may still be in an acceptable condition, the inner slant and the opening situated behind the inner slant may require revision. For this the present invention provides that a hole plate is arranged in the region of the recess and the hole plate is exchangeable. This enables on one hand avoiding wear and with this costly welding works on the bottom tool during maintenance, and on the other hand exchanging the hole plate for a different positioning of the hole a re-adjustment for the punching process can be performed.

Within the framework of the Invention it is conceivable, in particular when using a press-hardening tool, that the hole plate itself is cooled again or is configured coolable. For example the hole plate is closingly arranged on a corresponding cooling channel of the bottom die or is coupled with the cooling channel, so that here heat dissipation is possible via the hole plate.

Within the framework of the invention, in particular high-strength or ultra-high strength steel plates are formed to a motor vehicle part by means of hot-forming and press-hardening. The punching itself occurs in particular prior to the actual hardening process of the plate or the formed component.

BRIEF DESCRIPTION OF THE DRAWNINGS

Figure 2A:
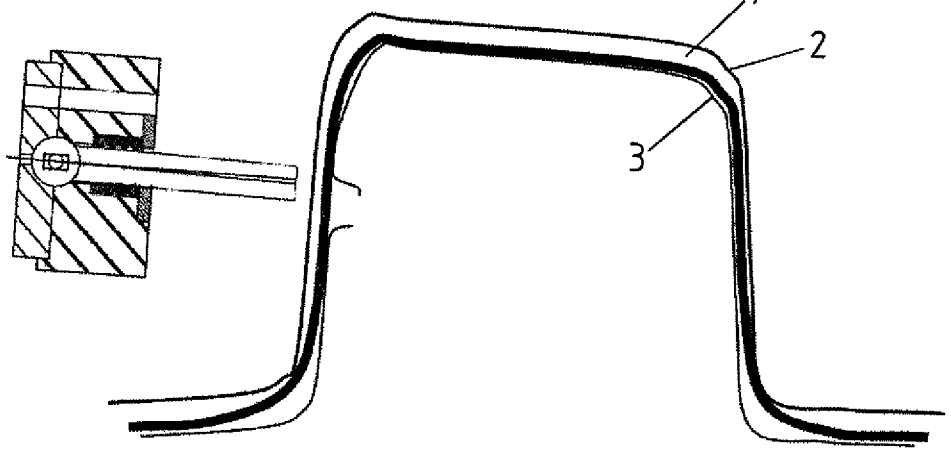
Figure 3:
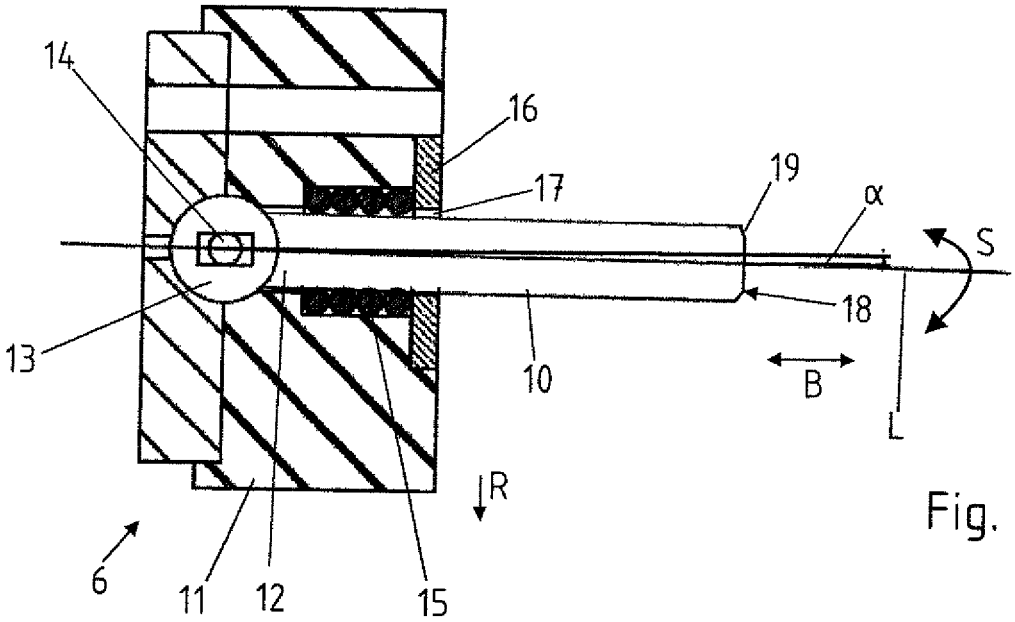
Figure 4:
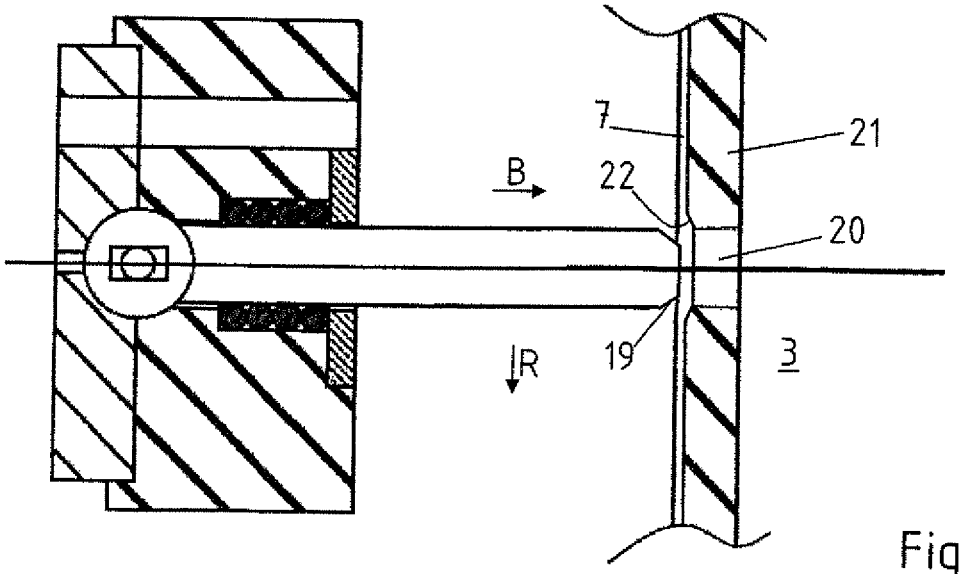

Further advantages features and properties of the present invention are the subject matter of the following description. Preferred embodiments are shown in the schematic Figures. These serve for facilitating understanding the invention. It is shown in:

FIG. 1 a forming tool according to the invention in a cross sectional view;

FIGS. 2*a*) and *b*) a closed forming tool with punch in a detail view prior to and after the punching;

FIG. 3 the pivotabilaty of the punch according to the invention;

FIG. 4 a punch according to the invention with hole plate;

FIGS. 5) and *b*) a respective sectional view through a ball head with centering pins in a ball socket with grooves;

FIG. 6 a resulting enveloping circle of the punch and

FIG. 7*a* to *d*) different front views of the punch.

DETAILED DESCRIPTION OF PREFERRED EMBODIMENTS

In the Figures the same reference signs are used for same or similar components even when a repeated description is not given for reasons of simplicity.

FIG. 1 shows a forming tool 1 according to the invention in the opened state, having a top die 2 and a bottom die 3. Between the top die 2 and the bottom die 3 a plate 4 is inserted. When performing a closing movement in vertical direction 5 a mold cavity 7 is generated between the top die 2 and the bottom die 3, which imposes the desired shape on the plate 4. Further a punch arrangement 6 is provided in the top die 2, which is supported for movement relative to the top die 2 in movement direction B. The movement direction B is configured substantially horizontal, whereas the closing movement of the top die 2 is performed in vertical direction 5. The punch arrangement is supported movable in a carriage guide 23 so that the punch arrangement is movable in movement direction B.

Figure 2B:
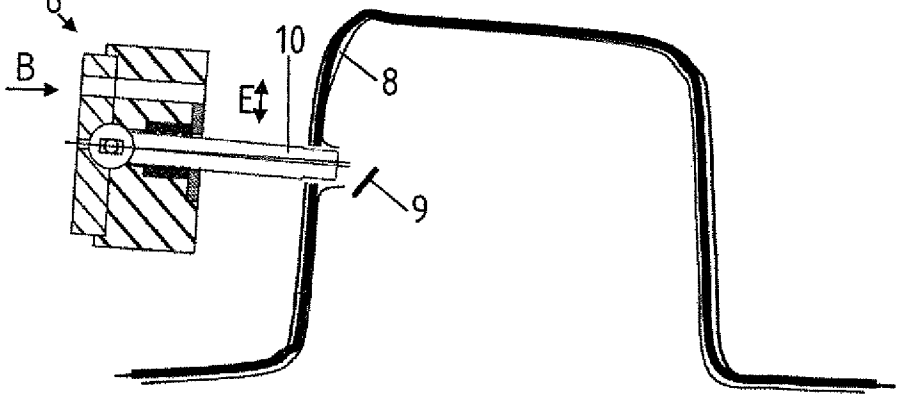

FIGS. 2*a*) and *b*) show a detail view of the forming tool in a closed state. In FIG. 2*a*) the forming tool 1 is almost completely closed and in FIG. 2 *b*) the forming tool is completely closed and the punch arrangement 6 has performed the relative movement in movement direction for performing the punching. The resulting mold cavity 7 between the top die 2 and the bottom die 3 can be recognized, wherein in FIG. 2*b*) it can be well recognized that inaccuracies, for example remaining hollow spaces 8, may occur when the forming tool is completely closed. According to FIG. 2*b*) the punch arrangement 6 has performed the punching movement in movement direction B and a corresponding section, also referred to as punch-out piece 9, falls into a not further shown receiving space or hollow space in the bottom die 3 so that the punch-out piece can be discharged for example for the purpose of being recycled.

In order to be able to perform an accurate punching and no jamming of the punch 6 in movement direction B occurs, the punch is in particular elastically supported orthogonal relative to its movement direction B. It is thus possible that the punch 10 is moved in the drawn-in movement direction E or is moved into the image plane or out of the Image plane, in particular by self-centering. When now inaccuracies occur upon contact or an extended wear of the top die 2 or bottom die 3 occurs, these inaccuracies can be compensated by the elastic movement of the punch 10.

According to the invention this is achieved in that the punch 10, as shown in FIG. 3, is coupled thrust-rigid with the sledge 11 in movement direction B of the punch arrangement 6. This thrust-rigid coupling at the foot region 12 of the punch 10 is achieved by a ball head 13 or a cylinder. In the case of a cylinder this makes it possible to perform a pivot movement S or in the case of a ball head 13 to perform a three-dimensional pivot movement S at simultaneous thrust-rigid coupling in movement direction B. Thus the punch 10 can be pivoted by a few degrees in a angle α. In the case of a ball head 13 a anti-rotation pin 14 is preferably additionally arranged so that the punch 10 does not rotate about its longitudinal axis L but only performs the pivot movement S.

In order to assume a starting position after the pivot movement S the punch 10 is elastically supported in radial direction R in the sledge 11 by elastic support rings 15. The elastic support rings 15 are secured in axial direction by a securing ring 16. The securing ring 16 has also an opening 17, which can serve as delimitation so that in case of a form fitting contact between the punch 10 and the opening 17 the pivot movement S is limited in radial direction R.

For accomplishing the self-centering a circumferential slant 19 is formed on the hole die head 18 of the punch 10. According to the representation in FIG. 4, the punch 6 dips into an opening 20 on the side opposite the punch 6, when performing the punching in movement direction B and pushing the punch 6 through mold cavity 7, here shown without plate. For this, preferably an exchangeable hole plate 21 is provided in the schematically indicated bottom die 3, wherein an inner slant 22 is formed on the hole plate 21 or on the entry point of the opening 20 in the hole plate 21. Thus a pivot movement S in radial direction R can be performed when performing the punching movement in movement direction B and in cooperation between the slant 19 and inner slant 22 a corresponding self-centering occurs.

Figure 5A:
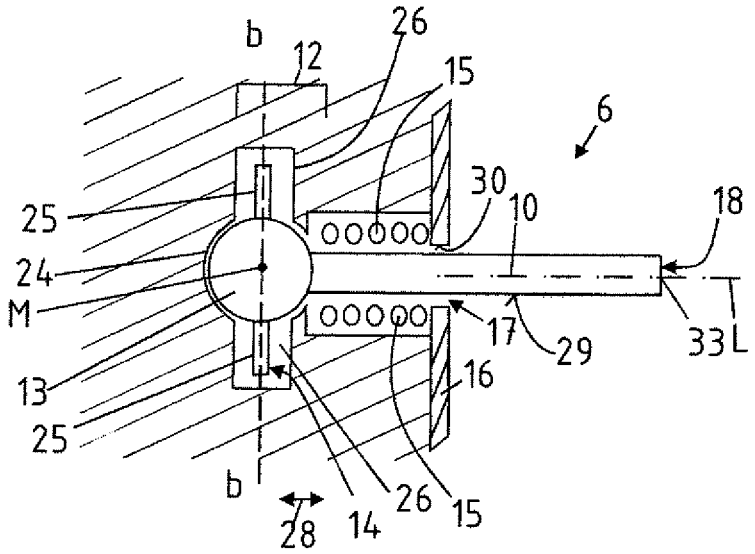
Figure 5B:
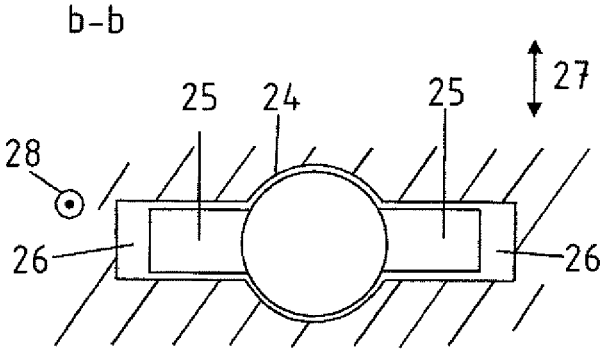

FIGS. 5*a*) and *b*) shown the punch 10 or ball head 13 in a respective sectional view. The punch 10 has a ball head 13, which is situated at the foot region 12 of the punch 10. The ball head 13 is supported pivotal or rotatable in a ball socket 24. The pin projections 25 of the anti-rotation pin 14 extend laterally protruding relative to the ball head 13, wherein these are configured so that an axis, which connects them extends through the center point M of the ball head 13. The pin projections 25 are respectively arranged in a groove 26, which is set back relative to the ball socket 24. The grooves 26 are configured so that in cooperation with the pin projections 25 they form a floating bearing with an axial or translational degree of freedom. This can be seen well in FIG. 5 *b*), in which a form fitting contact in movement direction 27 is established so that a movement in movement direction 27 is not possible. A movement into the image plane according to FIG. 5 *b*) and out of this image plane in direction 28, also shown in FIG. 5 *a*) represents the one degree of freedom of the floating bearing between groove 26 and pin projections 25. FIG. 5*b*) shows the cross section b-b from FIG. 5*a*).

In particular the punch head 18 can hereby perform a movement, which can be well seen in FIG. 6. According to position Pos 1 the punch head 18 is in the resting position or centered position so that its longitudinal axis L is arranged centered in the middle. When the punch head now performs the pivoting movement this is possible in the movement direction X as well as in the movement direction Y and also any intermediate position resulting therefrom. The opening 17 of the securing ring 16 form fittingly delimits the movement when the shaft 29 form fittingly contacts an inner sheath surface 30 of the opening 17, shown in FIG. 5*a*). FIG. 6 illustrates the case where the shaft 29 and the opening 17 are respectively configured circular. Thus a enveloping circle 31 results, which delimits the outer movement of the punch head 18 and is here illustrated as delimiting circle or enveloping circle 31 for the movement space 32 of a center point 33, in that the longitudinal axis L departs from the punch head 18. As an example the positions Pos 2, Pos 3 and Pos 4 are drawn in, wherein any desired intermediate position can be assumed due to the pivotal support of the foot region 12 in connection with the delimitation by the inner sheath surface 30 of the opening 17 and the center point 33 is respectively arranged inside the enveloping circle 31.

FIGS. 7*a*) to *d*) show different front views of the punch head 18. In the case of FIG. 7 *a*) the latter is quadrangular, in particular rectangular. According to FIG. 7 *b*) the punch head 18 is configured triangular and according to FIG. 7 *c*) the punch head 18 is configured oval and in Figure d) as polygon with inwardly and outwardly extending corners. The shaft 29 can then have the respective shape of the front view or can also be configured round.

What is claimed is:

1. A forming tool for press forming a plate, comprising:

a top die and a bottom die, wherein in a closed state of the forming tool a mold cavity remains between the top die and the bottom die;

a punch having a foot region and being pivotally supported by a pivotal support at the foot region, said punch having a first degree of freedom of movement so as to being movable relative to the forming tool in a movement direction, said punch being at least movable into the mold cavity and being supported elastically with at least one further degree of freedom of movement oriented transverse to the movement direction.

2. The forming tool of claim 1, wherein the pivotal support is formed by a cylinder or a ball head.

3. The forming tool of claim 2, wherein the ball head is supported in a ball socket on an actuator or sledge for rotation and thrust-rigid in movement direction.

4. The forming tool of claim 3, further comprising an anti-rotation mechanism arranged in the ball head.

5. The forming tool of claim 4, wherein the anti-rotation mechanism is an anti-rotation pin.

6. The forming tool of claim 4, wherein the ball head engages in a ball socket, wherein the anti-rotation mechanism is formed by two pin projections projecting from the ball head on two opposing sides, said pin projections engaging in a groove which is set back relative to the ball socket, thereby forming a floating bearing with a translational degree of freedom.

7. The forming tool of claim 1, wherein the punch has a punch head which has a round, oval or polygonal, cross sectional configuration.

8. The forming tool of claim 7, wherein the punch has a punch head 2 which has a quadrangular cross sectional configuration.

9. The forming tool of claim 1, configured as hot-forming tool and at least partially cooled press-hardening tool for steel plates.

10. The forming tool of claim 1, wherein the forming tool performs a movement in vertical direction and the punch performs a movement which is substantially oriented in horizontal direction or is oriented at an angle of 45° to 135° relative to the vertical direction.

11. The forming tool of claim 1, further comprising a carriage movable relative to the forming tool, said punch being fastened on the carriage.

12. The forming tool of claim 1, wherein the punch is elastically supported in radial direction.

13. The forming tool of claim 1, further comprising elastic support rings arranged on the punch and radially engaging around the punch.

14. The forming tool of claim 1, wherein the punch has a head end provided with a slant, or is configured tapered toward the head end.

15. The forming tool of claim 1, wherein the top die or bottom die which is opposite the punch has a hole template and the punch is movable into the hole template.

16. The forming tool of claim 15, wherein the hole template has an opening, said opening of the hole template having an inner slant.

17. The forming tool of claim 15, wherein the hole template is configured as a hole plate.

* * * * *